US011266956B2

(12) United States Patent
Perkins et al.

(10) Patent No.: US 11,266,956 B2
(45) Date of Patent: Mar. 8, 2022

(54) GAS/LIQUID INFUSION SYSTEM WITH INTELLIGENT LEVEL MANAGEMENT AND ADJUSTABLE ABSORPTION OUTPUT

(71) Applicant: Flow Control LLC, Beverly, MA (US)

(72) Inventors: Bernard L. Perkins, Orange, CA (US); Jesus Estrada, Irvine, CA (US); Akshaykumar Patel, Santa Ana, CA (US)

(73) Assignee: FLOW CONTROL LLC, Beverly, MA (US)

( * ) Notice: Subject to any disclaimer, the term of this patent is extended or adjusted under 35 U.S.C. 154(b) by 0 days.

(21) Appl. No.: 15/938,512

(22) Filed: Mar. 28, 2018

(65) Prior Publication Data

US 2018/0280896 A1 Oct. 4, 2018

Related U.S. Application Data

(60) Provisional application No. 62/477,745, filed on Mar. 28, 2017.

(51) Int. Cl.
*B01F 3/04* (2006.01)
*B67D 1/04* (2006.01)
(Continued)

(52) U.S. Cl.
CPC ..... *B01F 3/04815* (2013.01); *B01F 3/04737* (2013.01); *B01F 3/04808* (2013.01);
(Continued)

(58) Field of Classification Search
None
See application file for complete search history.

(56) References Cited

U.S. PATENT DOCUMENTS 4,008,832 A 2/1977 Rodth
4,028,441 A 6/1977 Richards
(Continued)

FOREIGN PATENT DOCUMENTS

CN 1345260 A 4/2002
CN 103201210 A 7/2013
(Continued)

OTHER PUBLICATIONS

Ray, Joe, "Review: DrinkMate Carbonator Under pressure," Wired, wired.com, Feb. 12, 2016. https://www.wired.com/2016/02/review-drinkmate-carbonator/.
(Continued)

*Primary Examiner* — Jason Lin
(74) *Attorney, Agent, or Firm* — Ware, Fressola, Maguire & Barber LLP

(57) ABSTRACT

A system features a controller having a signal processor configured to: receive signaling containing information about a liquid level of a gas infused liquid in a liquid/gas infusion tank/vessel, one or more gas input characteristics of a gas provided to the liquid/gas infusion tank/vessel, and one or more liquid input characteristics of an incoming non-infused liquid provided to the liquid/gas infusion tank/vessel; and determine corresponding signaling containing information to control a pump that provides the incoming non-infused liquid to the infusion tank/vessel on demand each time a beverage is dispensed with the gas infused liquid from the liquid/gas infusion tank/vessel and to maintain a desired liquid level and target equilibrium gas pressure in the liquid/gas infusion tank/vessel at a given temperature.

24 Claims, 5 Drawing Sheets

(51) Int. Cl.
*B67D 1/12* (2006.01)
*B01F 15/00* (2006.01)

(52) U.S. Cl.
CPC .. *B01F 15/00155* (2013.01); *B01F 15/00357* (2013.01); *B67D 1/0406* (2013.01); *B67D 1/1252* (2013.01); *B01F 2003/049* (2013.01); *B67D 2001/0487* (2013.01); *B67D 2001/1254* (2013.01)

(56) References Cited

U.S. PATENT DOCUMENTS

| | | | | |
|---|---|---|---|---|
| 4,187,262 | A | 2/1980 | Fessler et al. | |
| 4,205,599 | A * | 6/1980 | Franzosi | B01F 3/04815 261/133 |
| 4,518,541 | A | 5/1985 | Harris | |
| 4,545,505 | A | 10/1985 | Mueller et al. | |
| 4,708,827 | A | 11/1987 | McMillin | |
| 4,850,269 | A | 7/1989 | Hancock et al. | |
| 5,002,201 | A | 3/1991 | Hancock et al. | |
| 5,178,799 | A * | 1/1993 | Brown | B01F 3/04815 137/505.14 |
| 5,190,189 | A | 3/1993 | Zimmer et al. | |
| 5,592,867 | A | 1/1997 | Walsh et al. | |
| 6,021,922 | A | 2/2000 | Bilskie et al. | |
| 6,036,053 | A * | 3/2000 | Simmons | B01F 3/04815 222/1 |
| 6,138,995 | A | 10/2000 | Page | |
| 7,416,170 | B2 | 8/2008 | Jablonski et al. | |
| 7,533,682 | B2 * | 5/2009 | Gheorghe | G05D 7/0635 137/2 |
| 8,485,394 | B2 | 7/2013 | Tachibana et al. | |
| 9,033,315 | B2 | 5/2015 | Phillips et al. | |
| 9,107,448 | B2 | 8/2015 | Giardino et al. | |
| 9,423,051 | B2 | 8/2016 | Jaeger et al. | |
| 2003/0121937 | A1 * | 7/2003 | Black | B67D 1/06 222/129.1 |
| 2003/0177784 | A1 | 9/2003 | Walton et al. | |
| 2004/0232173 | A1 * | 11/2004 | Saveliev | B67D 1/1213 222/547 |
| 2009/0194564 | A1 * | 8/2009 | Tsubouchi | G01F 15/046 222/23 |
| 2011/0168640 | A1 * | 7/2011 | Gilmour | B01F 3/04503 210/703 |
| 2011/0180148 | A1 * | 7/2011 | Xia | B01F 3/04985 137/1 |
| 2012/0098148 | A1 | 4/2012 | Koslow et al. | |
| 2013/0108760 | A1 * | 5/2013 | Kumar | B01F 3/04737 426/477 |
| 2015/0024088 | A1 * | 1/2015 | Cohen | A23L 2/54 426/67 |
| 2015/0216355 | A1 | 8/2015 | Duvall | |
| 2015/0313401 | A1 * | 11/2015 | Chichilnisky | B01D 53/06 261/129 |
| 2016/0048137 | A1 * | 2/2016 | Phillips | G05D 9/12 137/2 |
| 2016/0222332 | A1 | 8/2016 | Peirsman et al. | |
| 2016/0303525 | A1 | 10/2016 | Boarman et al. | |
| 2017/0043992 | A1 | 2/2017 | Green | |
| 2017/0240405 | A1 * | 8/2017 | Gibson | B67D 1/0406 |

FOREIGN PATENT DOCUMENTS

| | | | |
|---|---|---|---|
| CN | 105877496 | A | 8/2016 |
| DE | 10 2009 053670 | A1 | 6/2011 |
| EP | 0 488 586 | A2 | 6/1992 |
| EP | 0630267 | B1 | 3/2007 |
| GB | 1494744 | A | 12/1977 |
| WO | 2007053665 | A2 | 5/2007 |

OTHER PUBLICATIONS

Morgenthaler, jeffreymorgenthaler.com, Jan. 2, 2014. http://www.jeffreymorgenthaler.com/2014/how-to-build-your-own-carbonation-rig/.

"43 Series / E Series Carbonators," McCann's®, sodadispenserdepot.com, 2011. http://www.sodadispenserdepot.com/Documents/mccanns_carbonator_specs.pdf.

English Abstract of CN 1345260 (also published as U.S. Pat. No. 6,460,730.

English Abstract of CN 103201210A.

English Abstract of CN 105877496A.

English Abstract of DE 102009053670A1.

* cited by examiner

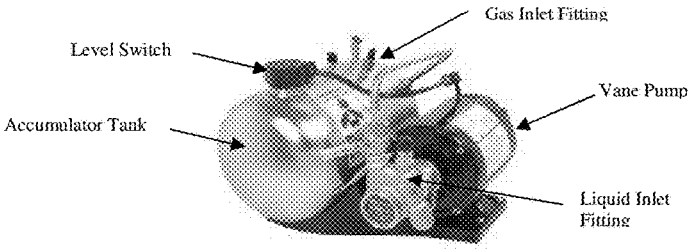
Figure 1: Standard Beverage Carbonator (Prior art)
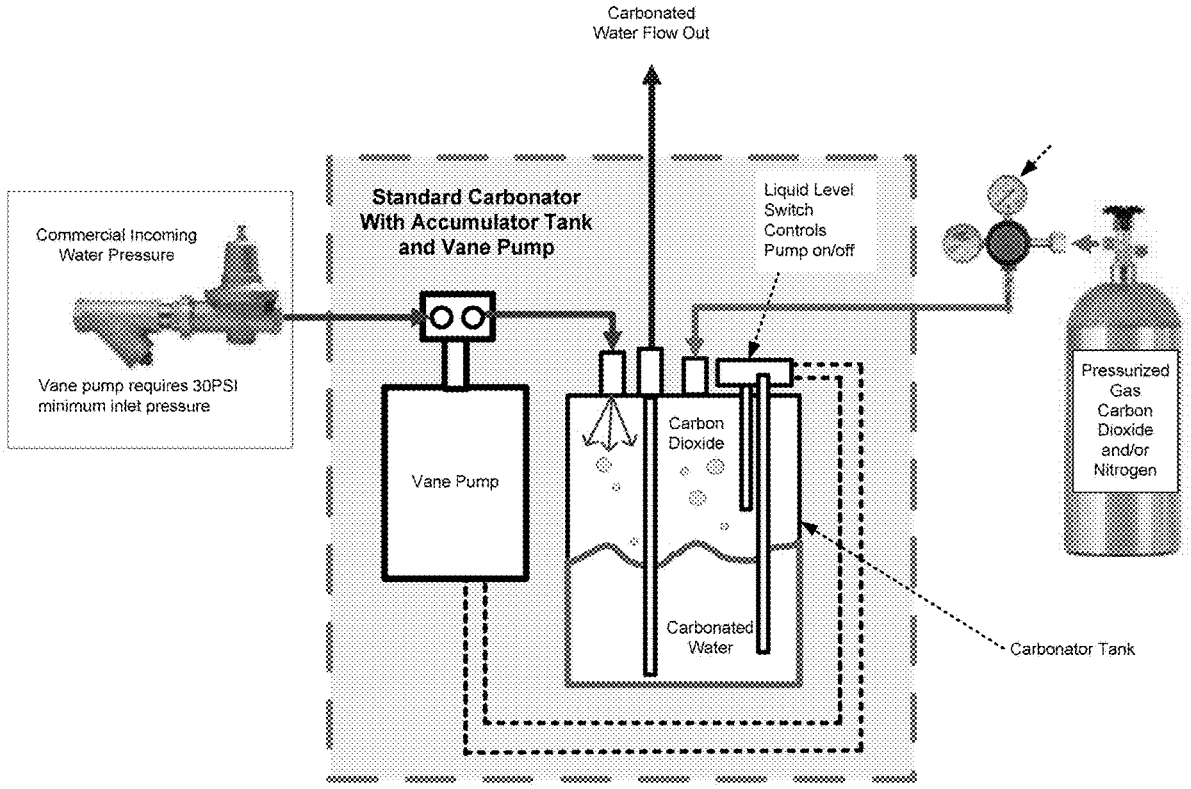
Figure 2: Standard Beverage Carbonator System Diagram (Prior art)

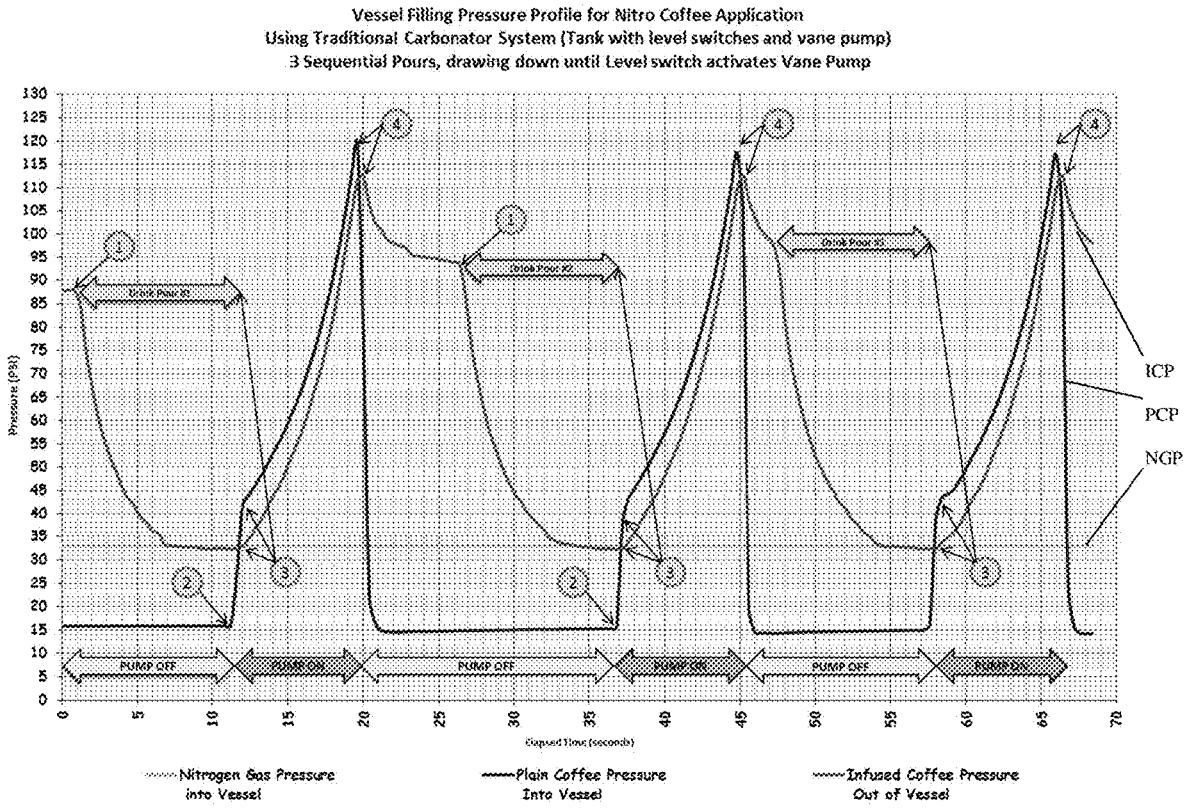
Figure 3: Standard Beverage Carbonator System

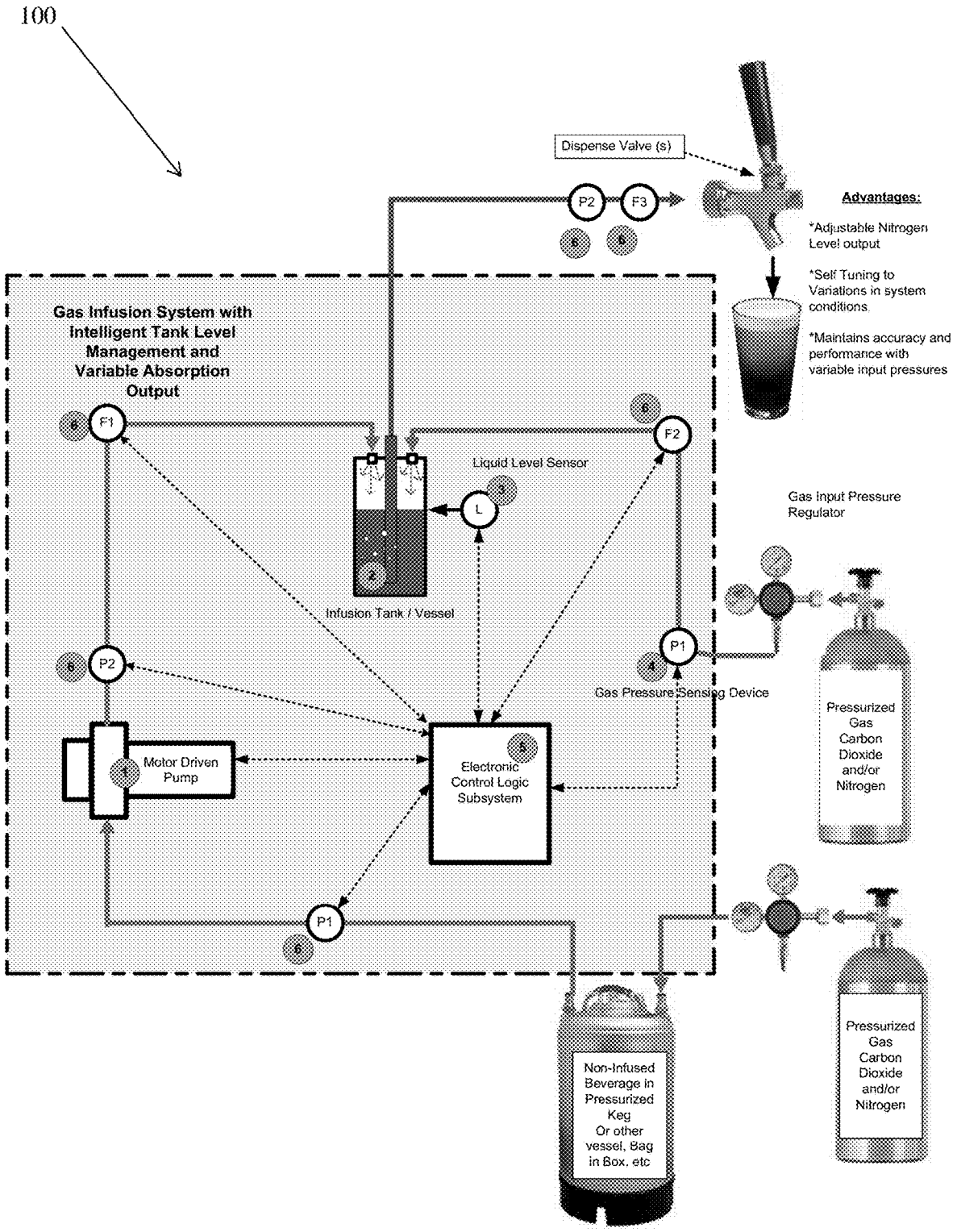
Figure 4: Gas Liquid Infusion System with Intelligent Level Management and Adjustable Absorption Level Ouput

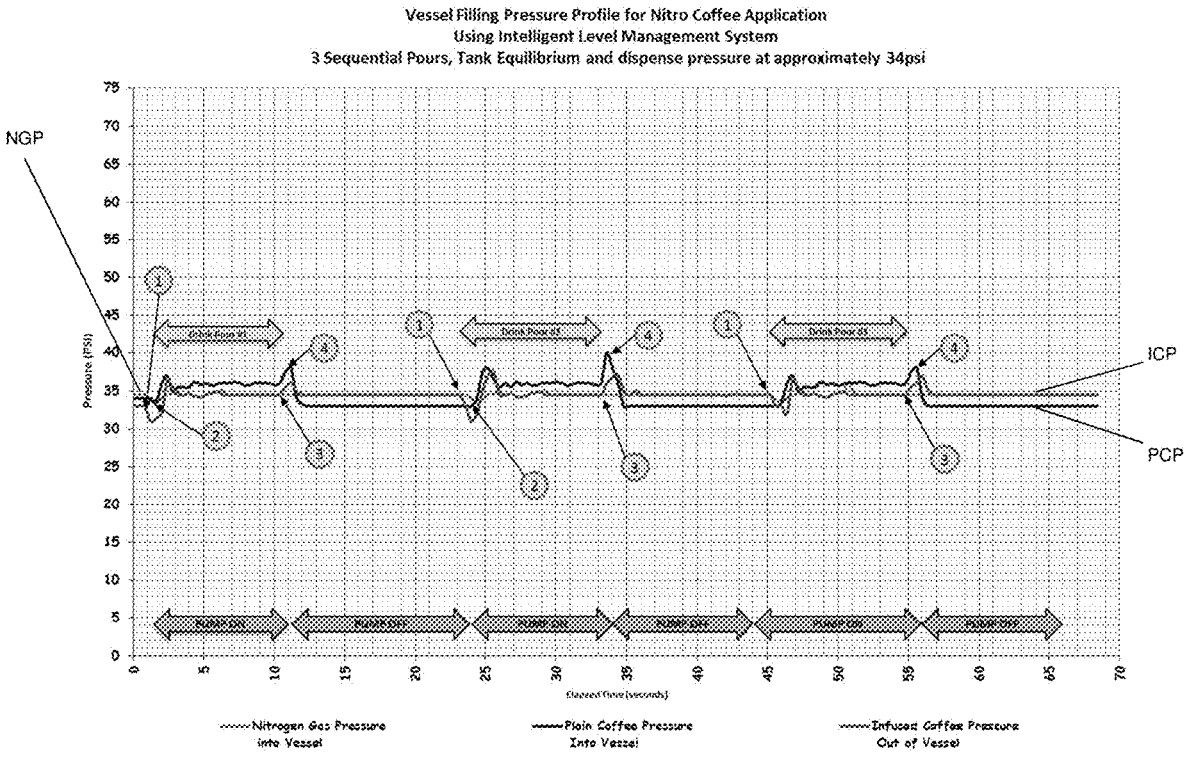
Figure 5: Pressure Profile for Intelligent Level Management Device

A system 100, including a gas/liquid infusion system,

An electronic control logic subsystem having a signal processor or signal processing module100a configured at least to:

receive signaling containing information about a liquid level of a gas infused liquid in a liquid/gas infusion tank/vessel, one or more gas input characteristics of a gas provided to the liquid/gas infusion tank/vessel, and one or more liquid input characteristics of an incoming non-infused liquid provided to the liquid/gas infusion tank/vessel;

determine corresponding signaling containing information to control a pump that provides the incoming non-infused liquid to the infusion tank/vessel on demand each time a beverage is dispensed with the gas infused liquid from the liquid/gas infusion tank/vessel and to maintain a desired liquid level and target equilibrium gas pressure in the liquid/gas infusion tank/vessel at a given temperature; and/or provide the corresponding signaling to control the pump by varying one or more pump characteristics, including voltage signaling provided to the pump.

Other signal processor circuits, circuitry, or components 100b that do not form part of the underlying invention, e.g., including input/output modules/modems, one or more memory modules (e.g., RAM, ROM, etc.), data, address and control busing architecture, etc.

Figure 6

GAS/LIQUID INFUSION SYSTEM WITH INTELLIGENT LEVEL MANAGEMENT AND ADJUSTABLE ABSORPTION OUTPUT

CROSS-REFERENCE TO RELATED APPLICATION

This application claims benefit to provisional patent application Ser. No. 62/477,745, filed 28 Mar. 2017, which is hereby incorporated by reference in its entirety.

BACKGROUND OF THE INVENTION

1. Field of the Invention

The present invention relates to a system for infusing a liquid with a gas, e.g., for beverage applications.

2. Brief Description of Related Art

1) Water Carbonator System with a Tank for Beverage Applications

Theory of operation: Consistent with that shown in FIG. 2, a standard beverage water carbonator is a device designed to dissolve carbon dioxide gas (CO2) in water, producing carbonated water. CO2 gas is delivered through a regulator to a carbonator tank gas inlet fitting. Plain water is pumped into the tank by a vane pump which is fed from a commercial water source. The CO2 gas, under pressure, dissolves in the water and the result is carbonated water. Some systems include chilling the water before, during, and/or after passing through the carbonator. When the liquid level of carbonated water reaches a liquid level sensing device (inside the tank) upper position probe, the liquid level switch opens a control circuit and the pump motor turns off. As carbonated water is drawn from the tank, the level of carbonated water will drop. At a certain point, the liquid level switch recognizes the drop in the level and closes the control circuit to turn on the pump motor which replenishes the amount of carbonated water that has been taken out of the tank. The output carbonation level produced is constant based on the equilibrium of the gas/liquid established at the temperature and pressure conditions of the system.

2) Inline Carbonator Devices, such as the assignee of the present invention's Carbjet (e.g., see U.S. Pat. No. 9,033,315 B2). This and similar inline carbonator devices enable mixing of liquid and gas in a flow through an inline mixing chamber as contrasted with the accumulator tank in the first example. The principles of operation are similar to the standard carbonator system, but there is no reservoir tank so the carbonation of the liquid must happen on demand. The differential pressure between the input gas and liquid streams determines the level of gas absorbed into the liquid at a given temperature and performance. There are different models on the market citing different advantages and performance characteristics, but they do not have the ability to adjust or maintain the set point target in real-time given changes in the supply streams.

Some of the Shortcomings of the Above Mentioned Devices

As previously mentioned, the amount of absorption of gas into liquid is a function on the temperature and pressure at which the gas and liquid are combined and allowed to establish equilibrium. The challenge in using traditional liquid carbonator technology described herein for variable output infusion is that the pressure of the input and output stream fluid fluctuates from low to high as the tank is filled. As a result, the equilibrium established within the tank is always changing during the filling and dispense cycles creating unpredictable and uncontrollable gas infusion levels.

For example, FIG. 3 shows a vessel filling pressure profile for a nitro coffee application using a traditional carbonator system (e.g., a tank with level switches and a vane pump), having 3 sequential pours, drawing down until the level switch activates the vane pump. In other words, the vessel filling pressure profile in FIG. 3 relates to the application of infusing nitrogen into coffee using the traditional carbonation system technology, e.g., having a vane pump (or some other pump like a gear pump) combined with a stainless tank with an internal liquid level sense probes). Consistent with that shown in FIG. 3, the vessel pressure varies from 15-120 PSI during the filling cycle of the tank and normal dispensing of beverages. Because of this variable pressure profile, the traditional carbonator system is not capable of producing constant carbonation output levels from drink to drink, nor is it capable of producing variable set points output carbonation levels by controlling the gas/liquid equilibrium for achieving various desirable end beverage quality characteristics.

FIG. 3 includes a series of steps/events labeled 1 thru 4, e.g., for drink pours labeled #1 thru #3. The drink pour #1 starts at an elapsed time of about 1 second and ends at the elapsed time of about 12 seconds; the drink pour #2 starts at the elapsed time of about 26.5 seconds and ends at the elapsed time of about 37 seconds; and the drink pour #3 starts at the elapsed time of about 47.5 seconds and ends at the elapsed time of about 57.5 seconds. The pump is OFF from the elapsed times of about 0 to 11.5 seconds, about 20 to 36.5 seconds, and about 45.5 to 58 seconds. The pump is ON from the elapsed times of about 11.5 to 20 seconds, about 36.5 to 45.5 seconds, and about 58 to 67 seconds. During the three drink pours #1, #2 and #3, the pump is basically turned OFF, and is turned ON after or at the end of the drink pours. For each drink pour, the sequence of steps/events labeled steps 1 thru 4 in FIG. 3 are as follows:

- Step 1) The dispense tap is opened, and the fluid pressure in the line drops as infused coffee is dispensed;
- Step 2) The vessel low level probe activates the pump to fill the tank until the upper level probe is reached;
- Step 3) The dispense tap is closed, and the fluid pressure builds as the pump continues to fill the vessel; and
- Step 4) The vessel full level probe de-activates the pump once the tank is full.

FIG. 3 shows three pressure functions in relation to the steps 1 thru 4, and also in relation to when the pump is turned ON/OFF, e.g., when nitrogen gas pressure is provided into the vessel (see the function labeled "NGP" in FIG. 3), when plain coffee pressure is provided into the vessel (see the function labeled "PCP" in FIG. 3), and when infused coffee pressure is provided out of the vessel (see the function labeled "ICP" in FIG. 3), for each drink pour #1, #2 and #3 in conjunction with when the pump is turned OFF and ON. In FIG. 3, the pressure for NGP, PCP and ICP functions are summarized as follows:

NPG: The NPG function is a substantially flat line function running at a substantially constant pressure of about 33 PSI, e.g., having no meaningful dips or increases in pressure during the three drink pours #1, #2 and #3, or the turning ON/OFF of the pump, as shown.

PCP: The PCP function starts at an elapsed time =0 at a PSI of about 16 PSI and ends at the elapsed time of about 68 seconds at a PSI of about 14. Before the end of drink pour #1, the pump is turned ON at the elapsed time of about 11.5 seconds, and the pressure of the PCP function increases from about 16 PSI to about 120 PSI at the elapsed time of about 19.5 seconds. When the pump is turned OFF at the elapsed time of about 20 seconds, the pressure of the PCP function decreases from about 100 PSI back down to about 15 PSI at the elapsed time of about 21 second, as shown. The pressure of the PCP function remains at about 15 PSI from the elapsed time of about 21 to 37 seconds with the pump turned OFF until the elapsed time of about 36.5 seconds. Before the end of drink pour #2, the pump is turned ON at the elapsed time of about 36.5 seconds, the pressure of the PCT function increases back up to about 120 PSI at the elapsed time of about 45 seconds, and repeats this cycle for the next 23 seconds until the elapsed time of about 68 seconds, which includes drink pour #3.

ICP: The ICP function starts at an elapsed time =0 at a PSI of about 87 PSI, and ends at the elapsed time of about 68 seconds at a PSI of about 97. Before the end of drink pour #1, the pump is turned ON at the elapsed time of about 11.5 seconds, and the pressure decreases from about 87 PSI at the elapsed time of about 1 second to about 33 PSI at the elapsed time of about 7 seconds and remains at about 33 PSI until the elapsed time of about 12 second. After the pump is turned on at the elapsed time of about 11.5 seconds, the pressure increases from about 33 PSI to about 112 PSI at the elapsed time of about 20 seconds when the pump is turned OFF. After the pump is turned OFF, the pressure of the ICP function decreases from about 112 PCI to about 94 PSI at the elapsed time of about 26.5 second when drink pour #2 starts. During drink pour #2, the pressure of the ICP function decreases from about 94 PSI to about 33 PSI at the elapsed time of about 37 seconds when drink pour #2 ends. After the pump is turned ON, the pressure of the ICP function increases from about 33 PCI at the elapsed time of about 37 seconds to about 112 PSI at the elapsed time of about 45 seconds, and repeats this cycle for the next 23 seconds until the elapsed time of about 68 seconds, which includes drink pour #3.

Summary of Shortcomings of Standard Beverage Dispenser Carbonator Devices (Vane or Gear Pump Coupled to a Tank with Internal Liquid Level Sensors)

Shortcomings of standard beverage dispenser carbonator devices include the following:

1) The gas infusion level of the fluid output is not user adjustable or real time adjustable.
2) The level of infusion varies from one drink to the next due to the large pressure fluctuation within the tank during the fluid filling cycle when operating at pressures below full saturation.
3) The output flow rate at the tap varies from drink to drink as the liquid output pressure fluctuates during the filling and dispense cycle.
4) The system is not "self-tuning" and cannot compensate for variation in incoming liquid or gas input pressures and still maintain target carbonation levels.

Summary of Shortcomings for Inline Carbonator as Compared to Standard Carbonators Commonly Used for Soda Beverage Post Mix Dispensing Shortcomings of the inline carbonator as compared to standard carbonator devices commonly used for soda beverage post mixing include the following:

Variable and controllable output levels may be achieved at various pressures settings; however, the current implementations of inline carbonators have performance limitations that limit their range of application to major carbonated/infused dispensed soda beverages.

Additional Limitations of Inline Devices

Some additional limitation of known inline devices include the following:

1) Not capable of achieving levels of infusion required by standard soft drinks without "breakout" (outgassing which creates drink flow interruptions and sputtering during dispense) and low carbonation quality characteristics.
2) Field installation system tuning is required for every varied in-store installation and/or system configuration. The level of infusion in an inline device is directly affected by the length and diameter of the outlet tubing, components, transitions in the system, all commonly referred to as "system restriction" or backpressure from tank outlet to dispense valve.
3) Internal flow path orifices subject to clogging and not able to be used with beverages containing suspended solids, particulates, etc.
4) "Breakout" (outgassing) during dispense at higher infusion level settings creates less than desired level of carbonation in the beverage and bad pouring of the beverage into the cup, splashing, sputtering, choppy flow.

SUMMARY OF THE PRESENT INVENTION

According to some embodiments, the present invention may include, or take the form of a gas/liquid absorption system with intelligent level management, e.g., that is able to overcome the limitations of traditional systems mentioned above by implementing an intelligent approach to maintaining the infusion tank's liquid level and equilibrium pressure. The system provides the flexibility of adjustable infusion levels and high infusion output levels required for the majority of carbonated beverages. This is accomplished through the use of an electronic controller and a control algorithm that controls the pump such that it is filled on demand each time a beverage is poured. (see FIG. 4) The filling must occur at a pressure greater than the gas input pressure, but without significant overshoot in order to maintain the desired target equilibrium pressure of the tank. The gas input pressure to the infusion tank/vessel determines the target equilibrium between gas and fluid at the given temperature of the system, and thereby the infusion level of the fluid within the tank.

Additionally, the gas/liquid absorption system is also able to maintain a consistent target value of gas absorption into liquid in the presence of "inconsistent or variable" incoming system liquid or gas pressures. This new and unique capability is essential for achieving preset or real-time adjustable gas infusion levels, and maintaining the target set point in the presence of variability in input pressures which are common in standard applications in the market today. Examples of this include incoming system water pressure fluctuations from building infrastructure or keg pressure fluctuations. This gas/liquid absorption system enables a more complete customization of beverages by introducing Nitrogen, CO2, and blended gases, e.g. at various system pressures and infusion levels.

The present invention overcomes the aforementioned application challenges/limitations through the use of pressure sensing devices and a controller with a control algorithm capable of making very precise incremental changes to the pump performance, thereby enabling precise micro adjustments to the pump output performance as the liquid level is replenished in order to keep the pressure constant during beverage dispense and system rest.

Particular Embodiments

By way of example, and according to some embodiments, the present invention may include, or take the form of, a system, such as a gas/liquid absorption system, featuring a controller having a signal processor configured to:

- receive signaling containing information about
  - a liquid level of a gas infused liquid in a liquid/gas infusion tank/vessel,
  - one or more gas input characteristics of a gas provided to the liquid/gas infusion tank/vessel, and
  - one or more liquid input characteristics of an incoming non-infused liquid provided to the liquid/gas infusion tank/vessel; and
- determine corresponding signaling containing information to control a pump that provides the incoming non-infused liquid to the infusion tank/vessel on demand each time a beverage is dispensed with the gas infused liquid from the liquid/gas infusion tank/vessel and to maintain a desired liquid level and target equilibrium gas pressure in the liquid/gas infusion tank/vessel at a given temperature.

The system may include one or more of the following features:

The signal processor may be configured to provide the corresponding signaling to control the pump by varying one or more pump characteristics, including voltage signaling provided to the pump.

The system may include the pump configured to respond to the corresponding control signaling and provide the incoming non-infused liquid to the liquid/gas infusion tank/vessel.

The system may include a liquid level sensor configured to sense the liquid level of the gas infused liquid in the liquid/gas infusion tank/vessel, and provide liquid level signaling containing information about the liquid level sensed.

The system may include one or more gas input characteristic sensors configured to sense the one or more gas input characteristics and provide gas input characteristic signaling containing information about the one or more gas input characteristics sensed.

The signal processor may be configured to receive the gas input characteristic signaling and provide the corresponding signaling.

The one or more gas input characteristic sensors may include a gas flow sensor configured to sense the gas flow of the gas and provide gas flow signaling containing information about the gas flow sensed.

The one or more gas input characteristic sensors may include a gas pressure sensor configured to sense the gas pressure of the gas and provide gas pressure signaling containing information about the gas pressure sensed.

The system may include one or more liquid input characteristic sensors configured to sense the one or more liquid input characteristics and provide liquid input characteristic signaling containing information about the one or more liquid input characteristics sensed.

The signal processor may be configured to receive the liquid input characteristic signaling and provide the corresponding signaling.

The one or more liquid input characteristic sensors may include a liquid flow sensor configured to sense the liquid flow of the gas and provide liquid flow signaling containing information about the liquid flow sensed.

The one or more liquid input characteristic sensors may include a liquid pressure sensor configured to sense the liquid pressure of the liquid and provide liquid pressure signaling containing information about the liquid pressure sensed.

The signal processor may be configured to receive gas infused liquid output characteristic signaling containing information about one or more gas infused liquid output characteristics of the gas infused liquid provided from the liquid/gas infusion tank/vessel each time the beverage is dispensed, and provide the corresponding signaling.

The system may include one or more gas infused liquid output characteristic sensors configured to sense the one or more gas infused liquid output characteristics and provide the gas infused liquid output characteristic signaling.

The system may include a gas pressure/flow control device configured to respond to gas pressure/flow control signaling and control the flow and pressure of the gas provided to the liquid/gas infusion tank/vessel.

The corresponding signaling may include the gas pressure/flow control signaling.

The system may include a non-infused liquid pressure sensor configured to sense the pressure of non-infused liquid provided from a non-infused liquid tank/vessel to the pump, and provide non-infused liquid pressure signaling containing information about the pressure of non-infused liquid.

The signal processor may be configured to receive the non-infused liquid pressure signaling and provide the corresponding signaling.

The system may take the form of a gas/liquid absorption system, e.g., consistent with that disclosed herein.

By way of example, advantages of the present invention include:

1) The capability to provide an adjustable nitrogen output level;
2) The capability for self tuning to variations in system conditions; and
3) The capability to maintain accuracy and performance with a variation in input pressure.

BRIEF DESCRIPTION OF THE DRAWING

The drawing, which is not necessarily drawn to scale, includes the following Figures:

FIG. 1 shows a standard beverage carbonator that is known in the art.

FIG. 2 is a diagram of a standard beverage carbonator system that is known in the art.

FIG. 3 is a graph of pressure (PSI) versus elapsed time (seconds) showing a vessel filling pressure profile for a nitro coffee application using a traditional carbonator system that is known in the art (e.g., a tank with level switches and a vane pump), including 3 sequential pours, and drawing down until the level switch activates the vane pump.

FIG. 4 is a diagram of a gas liquid infusion system with an intelligent level management and adjustable absorption level output.

FIG. 5 is a graph of pressure (PSI) versus elapsed time (seconds) showing a vessel filling pressure profile for a nitro coffee application, e.g., using an intelligent level management device, including 3 sequential pours, and showing tank equilibrium and dispense pressure at approximately 34 PSI, according to some embodiments of the present invention.

FIG. 6 is a block diagram of a system, e.g., such as a pump system having an electronic control logic subsystem with a signal processor or signal processing module for implementing the signal processing functionality, according to some embodiments of the present invention.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

FIG. 4 shows an adjustable inline gas infusion system generally indicated as 100 that operates by infusing gas into a liquid or beverage to a desired amount or end products dispense gasification characteristic level.

The adjustable inline gas Infusion system 100 consists of the following system elements:

A motor driven pump, labeled 1;

A gas liquid absorption vessel/tank, labeled 2;

A liquid level sensing device, labeled 3;

A gas pressure sensing device, labeled 4;

An electronic control subsystem labeled 5; and

Others sensors/devices within the system, labeled 6, e.g., including flow sensors F1, F2, F3 and pressure sensors P1, P2.

FIG. 4 also shows the following:

a keg or other vessel, bag in box, etc. configured to contain a non-infused beverage, e.g., such as coffee, tea, syrup, water, milk, etc.;

a tank configured to couple to the keg, vessel or bag in box, contain pressurized gas, e.g., such as carbon dioxide and/or nitrogen, and pressure the keg or other vessel, bag in box;

another tank configured to couple to the infusion tank/vessel 2, contain pressurized gas, e.g., such as carbon dioxide and/or nitrogen, and provide the pressurized gas to the infusion tank/vessel 2 for pressurizing the same; and a dispenser valve configured to move from a non-dispense position to a dispense position for turning on the dispenser valve, receive an infused beverage from the infusion tank/vessel 1, dispense the infused beverage received to a beverage container, and move to the non-dispense position for turning off the dispenser valve.

FIG. 4 shows how the incoming liquid stream pressure and flow that is provided to the system may be varied by application. For typical beverage soft drink carbonation applications, the water may be provided from the restaurant or store's commercial building water system. For beer, coffee, teas and other beverages, the incoming liquid may be provided from a Keg or other pressurized vessel, a bag in box, non-pressurized cask, bucket, or any other liquid containing vessel. The nitrogenated coffee example utilized a 3 gallon keg with 15 psi nitrogen input pressure.

By way of example, in FIG. 4 incoming non-infused liquid may be provided to the motor driven pump 1 via rigid tubing or flexible tubing or hose and fittings used in standard beverage dispense applications and plumbing systems. The function of the motor driven pump 1 is to manipulate the flow and pressure characteristics of the incoming liquid stream based on electronic communication received from the controller 5. The motor driven pump 1 can be any type of pump that is suitable for the liquid and performance desired. By way of example, pump types may include diaphragm, gear, lobe, flexible impeller, vane, centrifugal, etc. The motor driven pump 1 provides adjusted flow and pressure conditions to the infusion tank/vessel where the liquid is then mixed with gas.

The function of the infusion tank/vessel 2 in the system 100 is to mix the gas and liquid streams for the end result of infusing the gas into the liquid phase at a target equilibrium condition. The pressure and flow characteristics of the incoming fluid and gas streams influence the equilibrium established within the infusion tank/vessel 2 at a given temperature, pressure, and fluid output flow condition. The gas input is a regulated supply typically provided by gas storage cylinders and other types of pressurized vessels via properly rated tubing or hose, and fittings, consistent with that shown in FIG. 4. The gas may consist of 1 or more types of gas, premixed or fed separately into the infusion tank/vessel 2, e.g., provided by tanks, gas generators, or gas blenders. The incoming gas supply flows to the gas pressure sensing device prior to entering the infusion tank/vessel 2.

The function of the liquid level sensor 3 is to provide a liquid level feedback in the form of an input signal to the electronic control logic system 5. The liquid level sensor 3 can be a separate device in line, or a device that is incorporated as an integral part of the motor driven pump 1, the infusion tank/vessel 2, the gas pressure sensing device 4, the electronic control logic subsystem 5 or other external system component. The liquid level sensor 3 may be directly or indirectly sensing the liquid level and communicating the feedback through various types of process signal communication values and methods. The fluid is then introduced into the Infusion tank/vessel device 2.

The function of the gas pressure sensing device 4 is to provide gas pressure feedback in the form of an input signal to the electronic control logic system 5. The gas pressure sensing device 4 may be a separate device in line, or a device that is incorporated as an integral part of the infusion tank/vessel 2, the liquid level sensing device 3, the electronic control logic subsystem 5, or other external system component (e.g., represented by the various flow and pressure sensors 6). The liquid level sensing device 4 may be directly or indirectly sensing the pressure and communicating the feedback through various types of process signal communication values and methods.

The function of the electronic control logic system 5 is to receive input communication from the motor driven pump 1, the infusion tank/vessel 2, the liquid level sensor 3, the gas pressure sensing device 4, and other types of sensors in the system (e.g., represented by the various flow and pressure sensors 6) and implement the control logic. The electronic control logic system 5 provides output communication to the motor driven pump 1 for the purposes of achieving and maintaining the gas/fluid target equilibrium pressure conditions. The electronic control logic system 5 also provides output communication to the motor driven pump 1 for purposes of and maintaining level of fluid in the tank and controlling the flow performance of fluid entering the infusion tank/vessel 2. The electronic control logic system 5 also provides output communication to the motor driven pump 1 for purposes of maintaining the pressure between the incoming liquid and gas feed streams for the end intent of maintaining or changing the set point target for gas absorption desired in the liquid output without excessive overshoot of target setpoint pressures. The absorption level set point is achieved by monitoring the gas input pressure and liquid level sensors while maintaining the liquid streams and gas input streams at desired levels entering the infusion tank/vessel 2. This is accomplished by varying the characteristics of the voltage signal output to the motor driven pump 1 during the filling and dispense cycles. Adjustable levels of infusion can be achieved by adjusting the gas input pressure to the infusion tank/vessel 2. The electronic control logic system 5 may receive communication from the other sensors or devices in the system (represented by sensors 6), and use the information to implement control action or output communication to the motor driven pump 1, the infusion tank/vessel 2, the liquid level sensing device 3, the gas pressure sensing device 4, which are internal to the system, as well as other internal or external components or devices such as valves, switches, relays, displays, lights, etc. as needed to support auxiliary functions and other system operational objectives. The electronic control logic system 5 includes both electronic hardware components and software program(s), parameters, variables, and logic that are needed to execute the control algorithm and support the operation of the system.

The various sensors 6 shown represent various other sensors such as flow and pressure transducers, capacitive sensors, etc. that can be utilized with the logic in electronic control logic system 5 to support the primary function of the device or auxiliary functions of the system.

FIG. 5

Similar to, and consistent with, that shown in FIG. 3, FIG. 5 includes a series of steps/events labeled 1 thru 4, e.g., for drink pours labeled #1 thru #3. In FIG. 5, by way of example, the drink pour #1 starts at an elapsed time of about 1.5 seconds and ends at the elapsed time of about 11 seconds; the drink pour #2 starts at the elapsed time of about 23 seconds and ends at the elapsed time of about 33 seconds; and the drink pour #3 starts at the elapsed time of about 45 seconds and ends at the elapsed time of about 55 seconds. The pump is turned ON from the elapsed times of about 1.5 to 11 seconds during drink pour #1, about 24 to 34 seconds during and overlapping most of drink pour #2, and about 44 to 55 seconds during and overlapping drink pour #3, as shown. The pump is turned OFF from the elapsed times of about 11 to 24 seconds, about 34 to 44 seconds, and about 56 to 66 seconds, as shown. During the three drink pours #1, #2 and #3, the pump is basically turned ON, and is turned OFF after or at the end of the drink pours. For each drink pour, the sequence of steps/events labeled steps 1 thru 4 are implemented. See the description in FIG. 3.

FIG. 5 also shows three pressure functions in relation to the steps 1 thru 4, and also in relation to when the pump is turned ON/OFF. By way of example, the three pressure functions include an NGP function showing the pressure when nitrogen gas is provided into the infusion tank/vessel 2 in FIG. 4 (see the function labeled "NGP" in FIG. 5), an PCP function showing the pressure when plain coffee is provided into the infusion tank/vessel 2 (see the function labeled "PCP" in FIG. 5), and an ICP function showing the pressure when infused coffee is provided out of the infusion tank/vessel 2 (see the function labeled "ICP" in FIG. 5), for each drink pour #1, #2 and #3 in conjunction with when the pump is turned ON and OFF. Consistent with that shown in FIG. 4, the tank containing pressurized nitrogen may be configured to provide nitrogen gas to the infusion tank/vessel 2, and the motor driven pump 1 may be configured to the plain coffee as a non-infused beverage from the pressurized keg, or other vessel, bag in box, etc., to the infusion tank/vessel 2, as shown. Consistent with that also shown in FIG. 4, the infusion tank/vessel 2 may be configured to provide infused coffee to the dispenser valve, as shown.

In FIG. 5, the pressure for NGP, PCP and ICP functions are summarized as follows:

NPG: The NPG function is a substantially flat line function running at a substantially constant pressure of about 33 PSI, e.g., having no meaningful dips or increases in pressure during the three drink pours #1, #2 and #3, or the turning ON/OFF of the pump, as shown. Consistent with that shown in FIG. 5, the pressure of the NPG function includes some slight dips in pressure at elapsed times 1.5 seconds, 24 seconds and 46 seconds, e.g., when the pump is turned ON, with some slight dips in pressure at elapsed times 4.5 seconds, 27.5 seconds and 49 seconds, e.g., during the drink pours #1, #2 and #3, and with a slight increase in pressure at an elapsed time of about 51 seconds for about 1 second, all as shown in FIG. 5. The slight dips in pressure at the various elapsed times are about 1 PSI for about 1 second.

PCP: The PCP function starts at an elapsed time=0 at a PSI of about 34 PSI, and ends at the elapsed time=about 68 seconds at a PSI of about 33. From the elapsed time of 0 to 68 seconds, the pressure of the PCP function decreases/dips to about 33 PSI at the elapsed time of about 1.5 second when drink pour #1 starts, increases to about 37 PSI at the elapsed time of about 2.5 seconds, remains at about 36 PSI during the elapsed times from about 2.5 to 10 seconds during drink pour #1, increases to about 38 PSI after drink pour #1 ends at the elapsed time of about 10.5 seconds, decreases back to about 33 PSI at the elapsed time of about 12 seconds, and remains at about 33 PSI until the elapsed time of 24 second after drink pour #2 starts. After drink pour #2 starts at the elapsed time of about 23 seconds, the PCP function repeats a substantially similar cycle as shown.

ICP: The ICP function starts at an elapsed time=0 at a PSI of about 33 PSI, and ends at the elapsed time=about 68 seconds at a PSI of about 34. From the elapsed time of 0 to 68 seconds, the pressure of the ICP function decreases/dips to about 31 PSI at the elapsed time of about 1 second about when drink pour #1 starts, increases to about 37 PSI at the elapsed time of about 2.5 seconds, remains at about 34 PSI during the elapsed times from about 2.5 to 10.5 seconds until drink pour #1 ends, increases to about 36 PSI at the elapsed time of about 11 seconds after drink pour #1 ends, decreases back to about 34 PSI at the elapsed time of about 12 seconds, and remains at about 34 PSI until the elapsed time of 23.5 second after drink pour #2 starts. After drink pour #2 starts at the elapsed time of about 23 seconds, the PCP function repeats a substantially similar cycle as shown.

The NGP, PCP and ICP functions are shown by way of example only. The scope of the invention is intended to include, and embodiments are envisioned having, other types or kinds of NGP, PCP and ICP functions, e.g., having other types of pump ON/OFF times and elapsed time, other PSIs values, other pressure decreases/dips and/or increases, etc.

FIG. 6: Implementation of Signal Processing Functionality

By way of example, FIG. 6 shows a system generally indicated as 100, such as a gas/liquid infusion system with an intelligent level management and adjustable absorption output, featuring an electronic control logic subsystem, according to some embodiments of the present invention, e.g., having a signal processor or processing module **100*a*** configured at least to:

receive signaling containing information about a liquid level of a gas infused liquid in a liquid/gas infusion tank/vessel, one or more gas input characteristics of a gas provided to the liquid/gas infusion tank/vessel, and one or more liquid input characteristics of an incoming non-infused liquid provided to the liquid/gas infusion tank/vessel; and determine corresponding signaling containing information to control a pump that provides the incoming non-infused liquid to the infusion tank/vessel on demand each time a beverage is dispensed with the gas infused liquid from the liquid/gas infusion tank/vessel and to maintain a desired liquid level and target equilibrium gas pressure in the liquid/gas infusion tank/vessel at a given temperature.

In operation, the signal processor or processing module may be configured to provide the corresponding signaling to control the pump by varying one or more pump characteristics, including voltage signaling provided to the pump.

By way of example, the functionality of the signal processor or processing module 100*a* may be implemented using hardware, software, firmware, or a combination thereof. In a typical software implementation, the signal processor 10*a* would include one or more microprocessor-based architectures, e.g., having at least one signal processor or microprocessor. One skilled in the art would be able to program with suitable program code such a microcontroller-based, or microprocessor-based, implementation to perform the signal processing functionality disclosed herein without undue experimentation. For example, the signal processor 100*a* may be configured, e.g., by one skilled in the art without undue experimentation, to receive the signaling containing information about a liquid level of a gas infused liquid in a liquid/gas infusion tank/vessel, one or more gas input characteristics of a gas provided to the liquid/gas infusion tank/vessel, and one or more liquid input characteristics of an incoming non-infused liquid provided to the liquid/gas infusion tank/vessel, consistent with that disclosed herein.

Moreover, the signal processor 100*a* may also be configured, e.g., by one skilled in the art without undue experimentation, to determine the corresponding signaling containing information to control a pump that provides the incoming non-infused liquid to the infusion tank/vessel on demand each time a beverage is dispensed with the gas infused liquid from the liquid/gas infusion tank/vessel and to maintain a desired liquid level and target equilibrium gas pressure in the liquid/gas infusion tank/vessel at a given temperature.

The scope of the invention is not intended to be limited to any particular implementation using technology either now known or later developed in the future. The scope of the invention is intended to include implementing the functionality of the signal processor(s) 100*a* as stand-alone processor, signal processor, or signal processor module, as well as separate processor or processor modules, as well as some combination thereof.

By way of example, the system 100 may also include, e.g., other signal processor circuits or components generally indicated 100*b*, including random access memory or memory module (RAM) and/or read only memory (ROM), input/output devices and control, and data and address buses connecting the same, and/or at least one input processor and at least one output processor, e.g., which would be appreciate by one skilled in the art.

By way of further example, the signal processor 100*a* may include, or take the form of, some combination of a signal processor and at least one memory including a computer program code, where the signal processor and at least one memory are configured to cause the system to implement the functionality of the present invention, e.g., to respond to signaling received and to determine the corresponding signaling, based upon the signaling received.

Liquid Level Sensors and Other Devices

Liquid level sensors are known in the art, and the scope of the invention is not intended to be limited to any particular type or kind thereof either now known or later developed in the future.

Moreover, techniques are known in the art for arranging and/or implementing liquid/fluid level sensors in relation to tanks/vessels configured to hold a liquid in order to sense the level of the liquid contained therein, e.g., using the known liquid level sensors.

Motor driven pumps, infusion tank/vessels, gas pressure sensors, etc. are known in the art, and the scope of the invention is not intended to be limited to any particular type or kind thereof either now known or later developed in the future.

Possible Applications

Possible applications include the following:

Infusing CO2 or other Gases such as Nitrogen into liquids for beverages like Water, Soda, Beer, Coffee, Tea, Latte, Milk, and Yogurt Based. Infusing CO2 or other Gases such as Nitrogen into liquids for increasing the effectiveness of cleaning, sanitizing, etc. for example General Surface Cleaning, Soil extraction, Beverage Line Cleaning, Water Purification.

The Scope of the Invention

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. A system comprising:

a liquid level sensor configured to sense a liquid level of a gas infused liquid in a liquid/gas infusion tank/vessel, and provide liquid level signaling containing information about the liquid level sensed;

gas input pressure and flow sensors configured to sense a gas input pressure and flow and provide gas input pressure and flow signaling containing information about the gas input pressure and flow sensed;

liquid input sensors configured to sense a liquid input pressure and flow and provide liquid input pressure and flow signaling containing information about the liquid input pressure and flow sensed; and a controller having a signal processor configured to:

receive the liquid level signaling, the gas input pressure and flow signaling and the liquid input pressure and flow signaling, and provide control signaling containing information to vary characteristics of a voltage signal that is output to a pump for providing the incoming non-infused liquid with adjusted flow and pressure conditions to the liquid/gas infusion tank/vessel in order to control the incoming non-infused liquid and the flow and pressure of the gas provided to the infusion tank/vessel and maintain a desired liquid level and target equilibrium gas pressure in the liquid/gas infusion tank/vessel at a given temperature on demand each time a beverage is dispensed with the gas infused liquid from the liquid/gas infusion tank/vessel, based upon the signaling received.

2. A system according to claim 1, wherein the pump is a motor driven pump.

3. A system according to claim 1, wherein the system comprises the pump configured to respond to the corresponding signaling and provide the incoming non-infused liquid to the liquid/gas infusion tank/vessel.

4. A system according to claim 1, wherein the gas input pressure and flow sensors comprises a gas flow sensor configured to sense the gas flow of the gas and provide gas flow signaling containing information about the gas flow sensed.

5. A system according to claim 1, wherein the gas input pressure and flow sensors comprises a gas pressure sensor configured to sense the gas pressure of the gas and provide gas pressure signaling containing information about the gas pressure sensed.

6. A system according to claim 1, wherein the liquid input sensors comprises a liquid flow sensor configured to sense the liquid flow of the liquid and provide liquid flow signaling containing information about the liquid flow sensed.

7. A system according to claim 1, wherein the liquid input sensors comprises a liquid pressure sensor configured to sense the liquid pressure of the liquid and provide liquid pressure signaling containing information about the liquid pressure sensed.

8. A system according to claim 1, wherein the system comprises gas infused liquid output pressure and flow sensors configured to sense gas infused liquid output pressure and flow and provide gas infused liquid output pressure and flow signaling containing information about the gas infused liquid output pressure and flow of the gas infused liquid provided from the liquid/gas infusion tank/vessel each time the beverage is dispensed; and the signal processor is configured to receive the gas infused liquid output pressure and flow signaling, and provide the corresponding signaling.

9. A system according to claim 1, wherein the system comprises a gas pressure/flow control device configured to respond to the corresponding signaling and control the flow and pressure of the gas provided to the liquid/gas infusion tank/vessel.

10. A system according to claim 9, wherein the corresponding signaling includes gas pressure/flow control signaling.

11. A system according to claim 9, wherein the system comprises a non-infused liquid pressure sensor configured to sense the pressure of non-infused liquid provided from a non-infused liquid tank/vessel to the pump, and provide non-infused liquid pressure signaling containing information about the pressure of the non-infused liquid.

12. A system according to claim 11, wherein the signal processor is configured to receive the non-infused liquid pressure signaling and provide the corresponding signaling.

13. A method comprising:

sensing, with a liquid level sensor, a liquid level of a gas infused liquid in a liquid/gas infusion tank/vessel and providing liquid level signaling containing information about the liquid level sensed;

sensing, with a gas input pressure and flow sensors, a gas input pressure and flow and providing gas input pressure and flow signaling containing information about the gas input pressure and flow sensed;

sensing, with liquid input sensors, a liquid input pressure and flow and providing liquid input pressure and flow signaling containing information about the liquid input pressure and flow sensed; and receiving, with a controller having a signal processor, the liquid level signaling, the gas input pressure and flow signaling and the liquid input pressure and flow signaling, and providing control signaling containing information to vary characteristics of a voltage signal that is output to a pump for providing the incoming non-infused liquid with adjusted flow and pressure conditions to the liquid/gas infusion tank/vessel in order to control the incoming non-infused liquid and the flow and pressure of the gas provided to the infusion tank/vessel and maintain a desired liquid level and target equilibrium gas pressure in the liquid/gas infusion tank/vessel at a given temperature on demand each time a beverage is dispensed with the gas infused liquid from the liquid/gas infusion tank/vessel, based upon the signaling received.

14. A method according to claim 13, wherein the pump is a motor driven pump.

15. A method according to claim 13, wherein the method further comprises responding with the pump to the control signaling and providing the incoming non-infused liquid to the liquid/gas infusion tank/vessel.

16. A method according to claim 13, wherein the method further comprises configuring the gas input pressure and flow sensors with a gas flow sensor that senses the gas flow of the gas and provides gas flow signaling containing information about the gas flow sensed.

17. A method according to claim 13, wherein the method further comprises configuring the gas input pressure and flow sensors with a gas pressure sensor that senses the gas pressure of the gas and provides gas pressure signaling containing information about the gas pressure sensed.

18. A method according to claim 13, wherein the method further comprises configuring the liquid input sensors with a liquid flow sensor that senses the liquid flow of the liquid and provides liquid flow signaling containing information about the liquid flow sensed.

19. A method according to claim 13, wherein the method further comprises configuring the liquid input sensors with a liquid pressure sensor that senses the liquid pressure of the liquid and provides liquid pressure signaling containing information about the liquid pressure sensed.

20. A method according to claim 13, wherein the method further comprises sensing, with gas infused liquid output pressure and flow sensors, gas infused liquid output pressure and flow and providing gas infused liquid output pressure and flow signaling containing information about the gas infused liquid output pressure and flow of the gas infused liquid provided from the liquid/gas infusion tank/vessel each time the beverage is dispensed; and receiving, with the signal processor, the gas infused liquid output pressure and flow signaling, and providing the control signaling.

21. A method according to claim 13, wherein the method further comprises responding, with a gas pressure/flow control device, to the control signaling and controlling the flow and pressure of the gas provided to the liquid/gas infusion tank/vessel.

22. A method according to claim 21, wherein the control signaling includes gas pressure/flow control signaling.

23. A method according to claim 21, wherein the method further comprises sensing, with a non-infused liquid pressure sensor, the pressure of non-infused liquid provided from a non-infused liquid tank/vessel to the pump, and providing non-infused liquid pressure signaling containing information about the pressure of the non-infused liquid.

24. A method according to claim 23, wherein the method further comprises, receiving, with the signal processor, the non-infused liquid pressure signaling and providing the control signaling.

* * * * *